United States Patent [19]

Wanke et al.

[11] Patent Number: 4,475,459

[45] Date of Patent: Oct. 9, 1984

[54] IMPRESSION CYLINDER FOR SHEET-FED ROTOGRAVURE PRESSES

[75] Inventors: Johannes Wanke, Offenbach am Main; Kurt Difflipp, Dietzenbach; Jürgen Ruh, Heusenstamm, all of Fed. Rep. of Germany

[73] Assignee: M.A.N.-Roland Druckmaschinen Aktiengesellschaft, Fed. Rep. of Germany

[21] Appl. No.: 333,458

[22] Filed: Dec. 22, 1981

[30] Foreign Application Priority Data

Dec. 24, 1980 [DE] Fed. Rep. of Germany ..... 3049067

[51] Int. Cl.[3] ..... B41F 13/18; B41F 21/04

[52] U.S. Cl. ..... 101/410; 271/82

[58] Field of Search ..... 271/277, 82; 101/407–411, 232

[56] References Cited

U.S. PATENT DOCUMENTS

| | | | |
|---|---|---|---|
| 965,128 | 7/1910 | Middleworth | 101/410 |
| 1,078,238 | 11/1913 | Barber | 271/82 |
| 1,535,224 | 4/1925 | Harrold . | |
| 1,916,965 | 7/1933 | Cunningham | 271/82 |
| 2,092,189 | 9/1937 | Stobb | 101/410 |
| 2,395,444 | 2/1946 | Belluche | 101/410 |
| 3,125,022 | 3/1964 | Reinartz et al. | 101/410 |
| 3,663,014 | 5/1972 | Wasylenko | 271/82 |
| 3,937,142 | 2/1976 | Cerny et al. | 101/409 |
| 4,250,810 | 2/1981 | Fowler | 101/410 |
| 4,290,595 | 9/1981 | Thünker | 101/409 |

FOREIGN PATENT DOCUMENTS

| | | |
|---|---|---|
| 1611297 | 12/1970 | Fed. Rep. of Germany . |
| 2135714 | 6/1974 | Fed. Rep. of Germany . |

*Primary Examiner*—William Pieprz

*Attorney, Agent, or Firm*—Leydig, Voit, Osann, Mayer & Holt, Ltd.

[57] ABSTRACT

An impression cylinder for a rotogravure press having a recessed sheet stock gripper mechanism with a swivelling mechanism that swivels the grippers within the cylinder contour by revolving the grippers around a theoretical axis on the cylinder contour. The swivelling is rigidly and precisely constrained along an arcuate path by a plurality of arcuate guides disposed along the axial length of the cylinder. The opening and closing of the grippers and the swivelling of the grippers into the cylinder contour are caused to occur in sequence synchronized to the cylinder rotation by cam followers on gripper shaft pivot arms cooperating with cam followers journaled to the gripper shaft that are spring pressed onto cam surfaces fixed to the machine frame at the ends of the cylinder.

12 Claims, 8 Drawing Figures

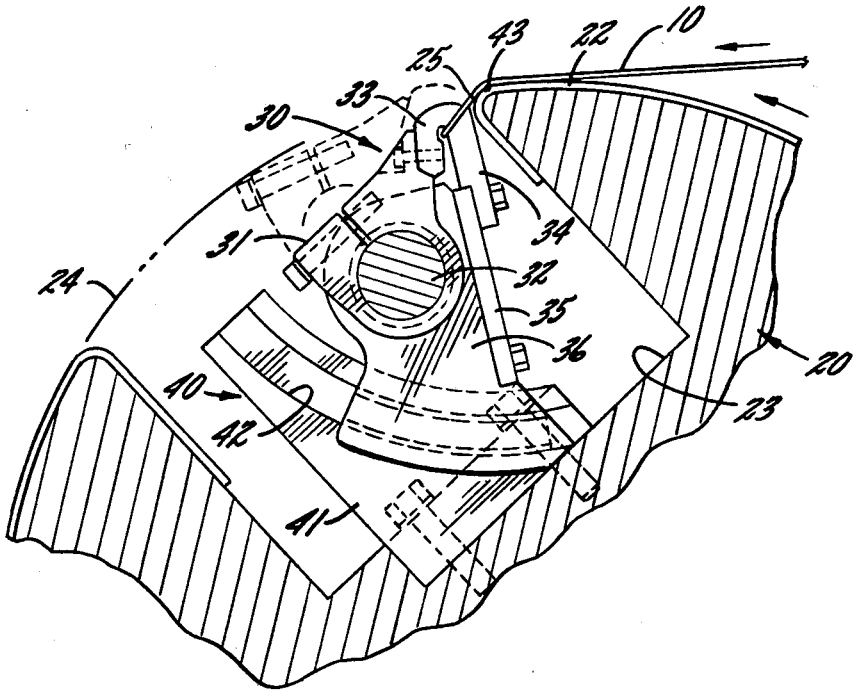

IMPRESSION CYLINDER FOR SHEET-FED ROTOGRAVURE PRESSES

BACKGROUND OF THE INVENTION

1. Field of the Invention

The invention relates to sheet-fed rotary printing presses wherein a plate cylinder cooperates with an impression cylinder. More particularly, the invention pertains to sheet-fed rotogravure presses, in which the impression cylinder is provided with grippers for holding individual printed sheets and which are cyclically swiveled into the impression cylinder in such a way that the grippers are totally within the cylinder contour. Specifically, the invention relates to a mechanism having gripper mounting brackets that swivel about a longitudinal axis lying at the leading edge of the cylinder surface.

2. Description of the Prior Art

U.S. Pat. No. 1,535,224 to C. W. Harrold issued Apr. 28, 1925 illustrates the well-known use of grippers, mounted on a rocking gripper shaft that is rocked by a cam follower on a pivot arm secured to the shaft and spring pressed against a cam surface fixed to the machine frame, for gripping individually fed sheets in a rotary printing press.

West German Patent Application No. 1,611,297 published Dec. 10, 1970 discloses a mechanism which rotates the point at which individually fed sheets are gripped about a longitudinal axis lying at the leading edge of the cylinder surface by means of a system of cranks and levers driven by a cam follower following a cam surface fixed to the machine frame.

West German Pat. No. 2,135,714 issued June 20, 1974, discloses a gripping mechanism that grips sheets that are individually fed to a rotary press followed by movement of the grippers radially inward below the surface of the cylinder driven by a cam follower following a cam surface fixed to the machine frame.

On rotogravure presses it is known that the cylinders used preferably have a narrow gap, particularly those with so-called wrap-around plates. This is firstly because large cylinder gaps on rotary presses lead to nonprintable zones resulting in waste. Secondly, the ink on the plate cylinder must be removed by a doctor blade. But a large cylinder gap causes an accumulation of ink and an increased tendency for the blade to "fall into the gap" with resultant vibration and spattering of ink. Thus, with a plate cylinder for gravure printing the aim is always to provide a "closed" cylinder without a substantial cylinder gap.

An obstacle to the use of a closed plate cylinder in sheet-fed rotogravure presses is that the impression cylinder must have grippers to hold the individual printed sheets. It is desirable to have the backs of the grippers extend beyond the contour of the impression cylinder so that the grippers may easily receive the fed sheets. But the grippers must retract into the impression cylinder to permit the plate cylinder to cyclically roll against the impression cylinder at the gripper position.

The German Pat. No. 2,135,714 provides for cyclically retracting the grippers within the plate cylinder contour, but has the disadvantage that the gripped edge of the fed sheet is pulled against the leading edge of the cylinder at the risk of tearing the sheet.

The arrangement disclosed in German Patent Application No. 1,611,297 utilizes a gripper which retracts within the impression cylinder contour while also preventing binding and scraping problems by using a swiveling mechanism that swivels the grippers about a longitudinal axis lying at the leading edge of the impression cylinder surface. The gripper and gripper pad are inserted by a roller, which is moved by a control cam. This arrangement, however, has the disadvantage that play in the system leading to premature wear is unavoidable in the lever gear and the associated pivots. A further disadvantage is that the gripper pad is mounted with the gripper on an additional lever, which has a further fixed point of rotation. Another important disadvantage of the arrangement is that the gripper shaft is mounted at only two points and thus does not have the stability required for high quality, high speed printing.

SUMMARY OF THE INVENTION

The general aim of the invention is to provide a swiveling mechanism for the grippers of an impression cylinder of a sheet-fed rotogravure press which does not risk damage to the sheet and which has a simple, durable, and reliable mechanical construction.

A further object is to provide a swiveling mechanism that precisely and accurately swivels about an axis of rotation on the impression cylinder surface so that printing quality is improved by the more accurate and stable mounting of the grippers.

Yet another object is to provide a swiveling mechanism that can be manufactured at lower cost.

In accordance with the present invention, an impression cylinder for a sheet-fed rotogravure press is provided with an improved swiveling device adapted to swivel the grippers within the cylinder contour. The gripper shaft to which the grippers are fastened is journaled to a plurality of gripper brackets that are mounted for a swiveling motion about a theoretical axis of revolution on the impression cylinder surface near the trailing edge of an axial groove in the impression cylinder which receives the swiveling mechanism. The opening and closing of the grippers is performed by an axial rotation of the gripper shaft, while the swiveling of the entire mechanism into the axial groove and thus within the imaginary surface of the impression cylinder is obtained by a generally radially inward translation of the gripper shaft with respect to the impression cylinder axis. In practical terms, the gripping and swiveling motions are coordinated by cams fixed to the machine frame at the ends of the impression cylinder with the swiveling motion obtained by a cam follower coaxial with the gripper shaft, and the rotation of the gripper shaft obtained by a cam follower on the end of a pivot shaft fixed to the end of the gripper shaft. For improved swiveling stability, the means for mounting the gripper brackets to the impression cylinder includes an arcuate groove on the impression cylinder receiving an arcuate lug fixed to the gripper brackets with a number of flat needle bearing cages holding needle bearings between the cooperating surfaces of the arcuate groove and arcuate lug. Moreover, to precisely define the point at which the grippers are extended out of the impression cylinder for receiving the individually fed sheets, an adjustable stop in an adjustable stop holder fixed to the impression cylinder limits the outward swiveling of the gripper mechanism. The stability of the cyclical swiveling is also improved by having dual cams fixed to the machine frame and coaxial cam followers for driving the swiveling motion at both ends of the gripper shaft, and the cam followers are pressed into intimate contact with the cam surfaces by dual compression springs mounted in both ends of the impression cylinder.

BRIEF DESCRIPTION OF THE DRAWINGS

Other objects and advantages of the invention will become apparent upon reading the following detailed description and upon reference to the drawings in which.

Figure 1A:
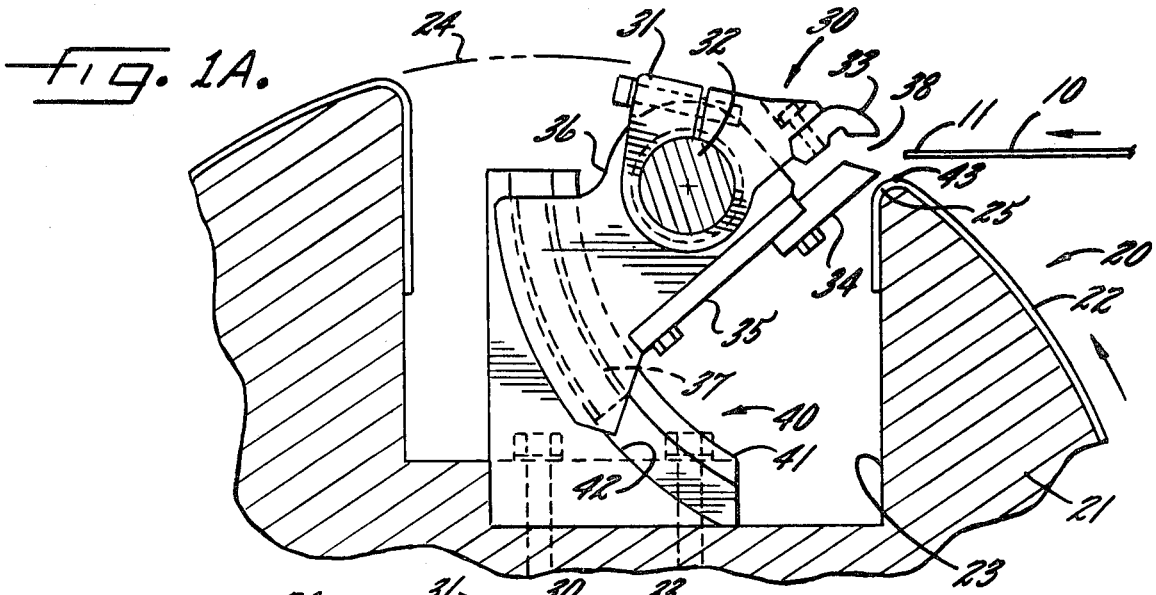
FIGS. 1A, 1B, and 1C are stop motion diagrams illustrating the operation of the grippers for gripping the individually fed sheets and the swiveling of the gripping mechanism within the impression cylinder surface in accordance with the invention and corresponding to the phases $\phi_A$, $\phi_B$, and $\phi_C$ respectively in FIG. 2.

While the invention is susceptible to various modifications and alternative forms, a speicific embodiment thereof has been shown by way of example in the drawings and will herein be described in detail. It should be understood, however, that it is not intended to limit the invention to the particular form disclosed, but, on the contrary, the intention is to cover all modifications, equivalents and alternatives falling within the spirit and scope of the invention as defined by the appended claims.

DESCRIPTION OF THE PREFERRED EMBODIMENT

Turning now to the drawings, in FIG. 1A a single sheet 10 having a leading edge 11 is shown being fed toward the impression cylinder generally designated 20. The cylinder has a cylinder body 21, a cylinder blanket 22, and an axial groove 23. The gripper mechanism generally designated 30 is disposed within the axial groove 23 and has an outwardly extended position which, as shown in FIG. 1A, lies partially outside of the imaginary cylinder surface 24 shown as a phantom line. The gripper mechanism 30 has a gripper shaft 32 upon which a number of rockable grippers 31 are attached for rocking motion coincident with rocking of the gripper shaft 32. At the trailing edge of the rockable gripper 31, it being understood that the impression cylinder 20 rotates in a counter clockwise direction, there is attached a gripper tooth 33 opposite to a gripper pad 34 defining a sheet entry way 38 for receiving the leading edge 11 of the individually fed sheet 10. The gripper pad 34 is mounted to a gripper bar 35 which is in turn secured to a gripper bracket 36 within which the gripper shaft 32 is journaled for free rotation. The gripper bracket 36 is mounted for a swiveling motion about a theoretical axis of revolution 43 on the impression cylinder surface 24 near the trailing edge 25 of the axial groove 23 which corresponds to the leading edge of the cylinder surface. The bracket 36 has a mounting mechanism generally designated 40 comprising a bracket 41 secured to the cylinder body 21. The bracket has an arcuate guide or groove 42 which receives an arcuate lug 37 that is an integral part of the bracket 36.

Figure 1B:
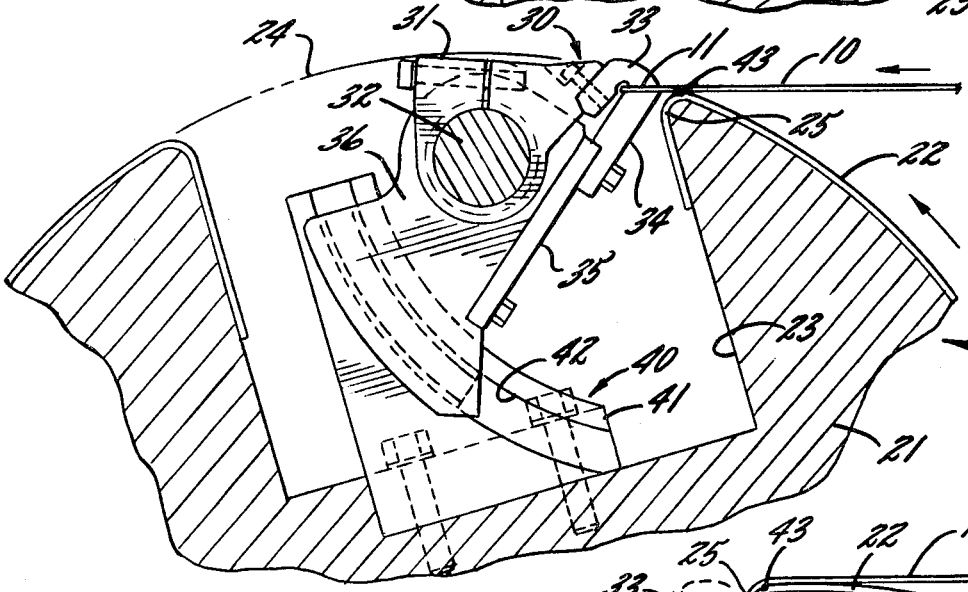
Figure 2:
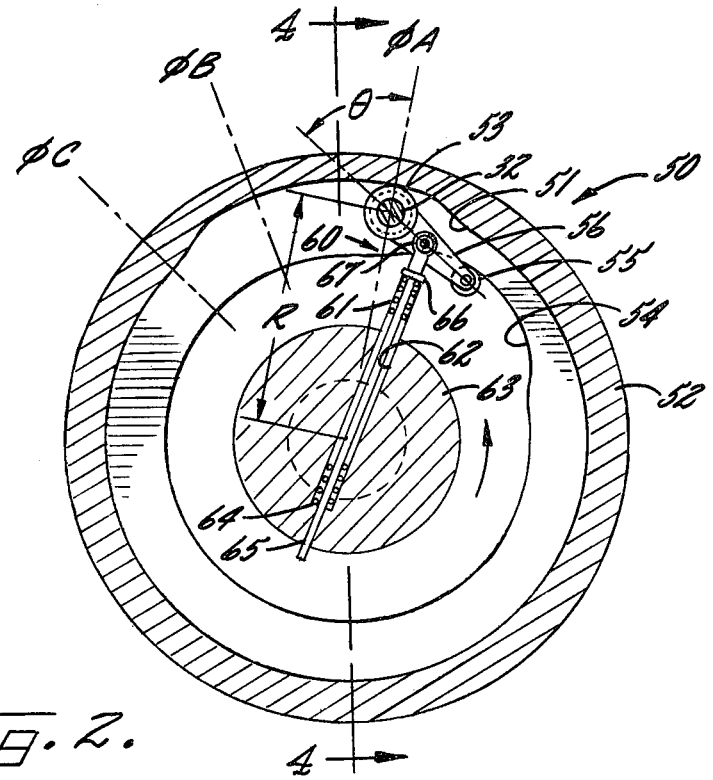
FIG. 2 is a schematic diagram showing the swiveling and rotational cam profiles taken along line 2—2 in FIG. 4.

FIG. 1B shows the gripper mechanism 30 after the impression cylinder 20 has rotated approximately 25 degrees from the $\phi_A$ phase to the $\phi_B$ phase shown in FIG. 2. The gripper shaft 32 has rotated clockwise slightly with respect to the impression cylinder 20 so that the gripper tooth 33 has gripped the leading edge 11 of the individually fed sheet 10 and holds it against the gripper pad 34.

Figure 1C:
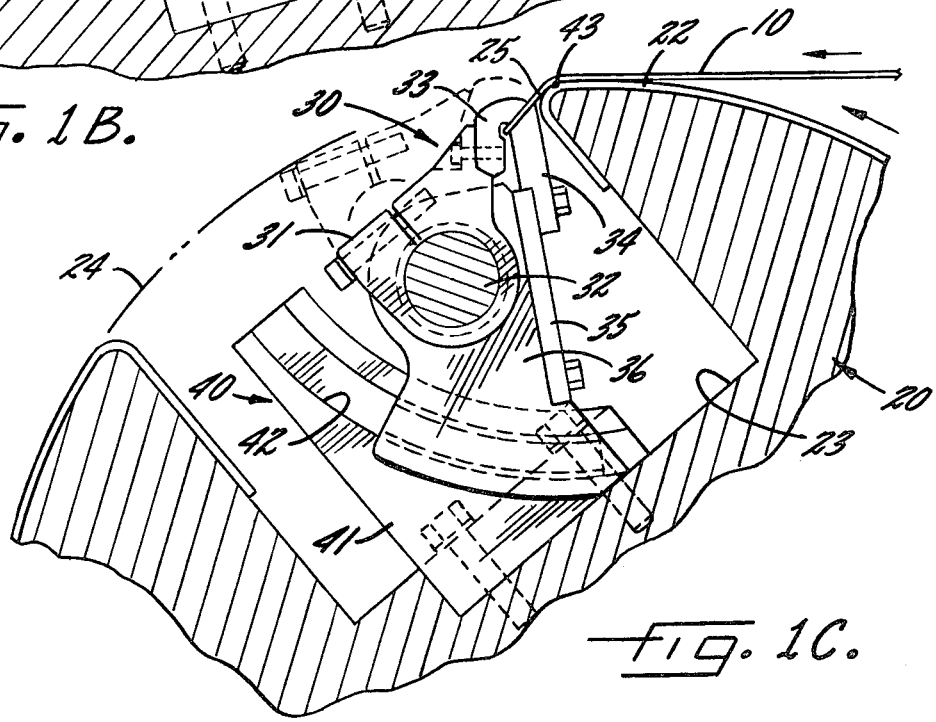

FIG. 1C shows the gripper mechanism 30 in its retracted position when the impression cylinder 20 has rotated to the $\phi_C$ phase in FIG. 2 approximately 50 degrees from its initial position shown in FIG. 1A. The original extended position is shown in phantom lines for comparison. It should be noted that when the swiveling occurs the fed sheet 10 bends rather than slides around the trailing edge 25 of the cylinder gap 23.

Figure 3:
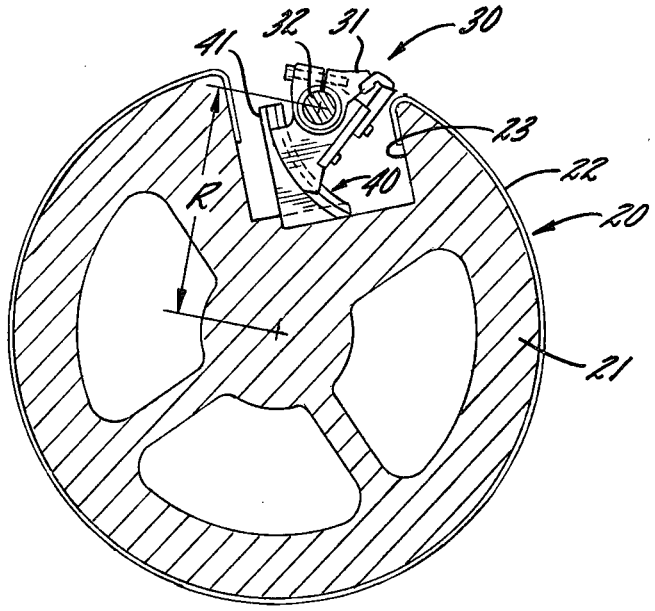
FIG. 3 is a cross sectional view taken along line 3—3 FIG. 4, showing the gripper mechanism with the same scale, phase and axial orientation as in FIG. 2 for comparison.

FIG. 2 shows the cam profiles used to perform the shaft rotation and swiveling motions illustrated in FIGS. 1A, 1B and 1C. For comparison FIG. 3 shows a cross sectional view of the swiveling mechanism having the same scale, phase and axial orientation as FIG. 2. The cam mechanisms generally designated 50 are generally cylindrical about the axis of the impression cylinder 20. The swiveling motion of the gripper mechanism 30 is determined by a swiveling cam profile 51 fixed to the machine frame 52 that is tracked by a cam follower 53 coaxial with and journaled to the gripper shaft 32. Thus the swiveling cam profile 51 determines the radial distance R from the axis of the gripper shaft 32 to the axis of the impression cylinder 20. This variation in radial distance R translates to a swiveling of the gripper mechanism 30 since the axis of the gripper shaft 32 is also constrained to a fixed radial distance from the theoretical axis of revolution 43 set by the radius of curvature of the arcuate surfaces of the groove 42 and lug 37 of the swiveling mechanism 40.

The rotation of the gripper shaft 32, which determines therefore the angular orientation of the gripper 31 with respect to the ray from the axis of the impression cylinder 20 passing through the axis of the gripper shaft 32, is established by an angle $\theta$ which is defined jointly by the revolution cam profile 53 and the profile of a rotation cam surface 54 also fixed to the machine frame 52. The rotation cam surface 54 is tracked by a rotation cam follower 55 journaled to a pivot arm 56 which is secured to the gripper shaft 32, so that the angle $\theta$ is defined by the triangle with vertices at the axes of the impression cylinder 20, the gripper shaft 32, and the rotation cam follower 55.

The cam followers 53, 55 are pressed into intimate contact with the cam surfaces 51, 54 by a compression bias spring mechanism generally designated 60 including a compression bias spring 61. The bias spring 61 is received by a stepped hole 62 in the end of the impression cylinder 63. The hole 62 has a retaining step 64 for retaining one end of the compression spring 61, and the other end of the compression spring 61 is retained by a retainer cap 66 secured to a spring bar 65 which is coaxial with the spring axis and passes through the end of the impression cylinder 63. The spring bar 65 is attached to a swivel 67 which is pinned to the pivot arm 56 that is secured to the gripper shaft 32.

Figure 4:
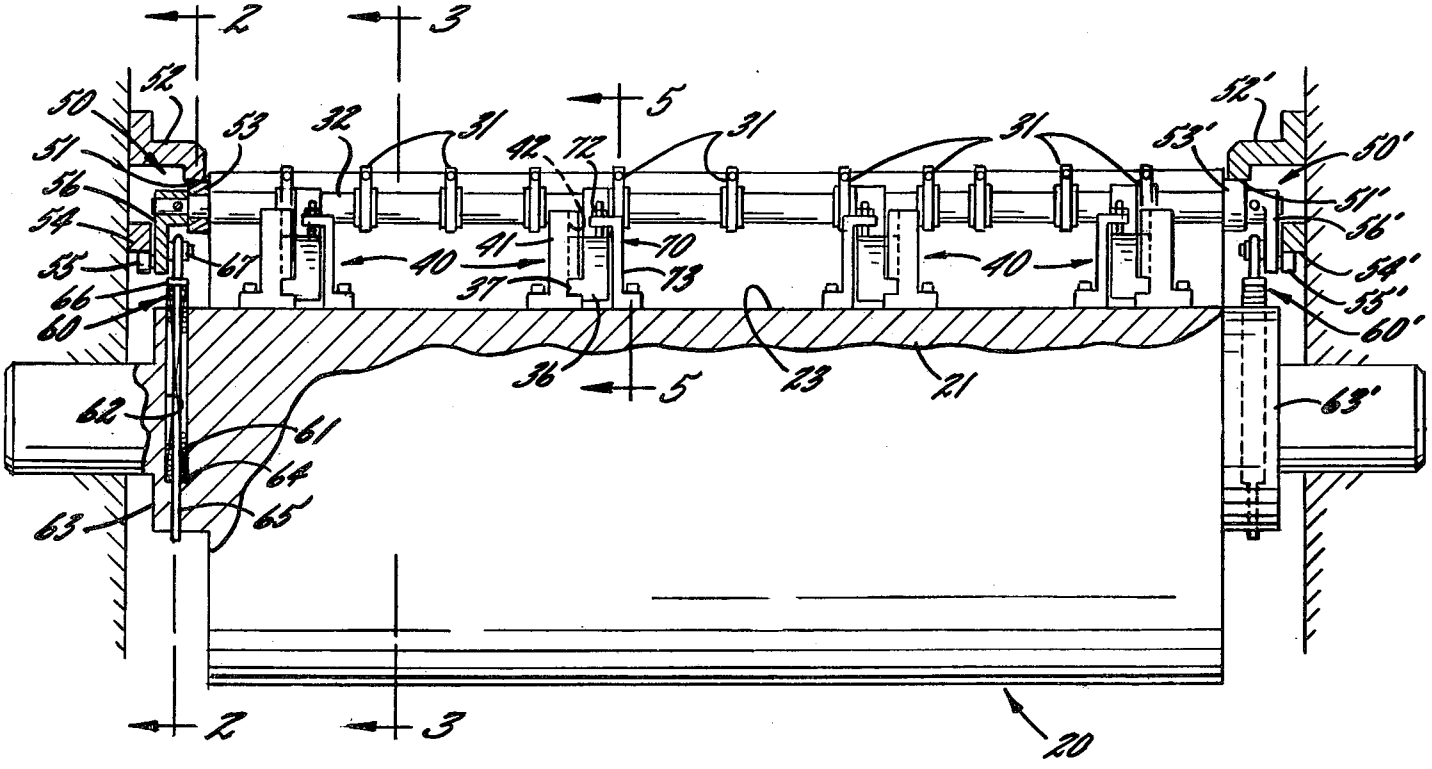
FIG. 4 is a fragmentary elevational view of the impression cylinder taken substantially along line 4—4 of FIG. 2 illustrating that a plurality of grippers, gripper brackets, and gripper stops are disposed along the axial length of the impression cylinder.

The connection between the cam mechanism 50 and the gripper mechanism 32 is illustrated in the elevation view of FIG. 4 which is a view perpendicular to the axis of the impression cylinder 20. The cam mechanism in FIG. 2 appears in section on the left end 63 of the impression cylinder. A similar mechanism appears at the right end 63' of the impression cylinder. The similar components are designated with identical but primed reference numerals. The use of two swiveling cam profiles 51, 51' insures that the swiveling of the gripper mechanisms is generally uniform along the length of the impression cylinder 20. For this same purpose a plurality of grippers 31 and swiveling mechanisms 40 are disposed along the length of the axial groove 23.

Figure 5:
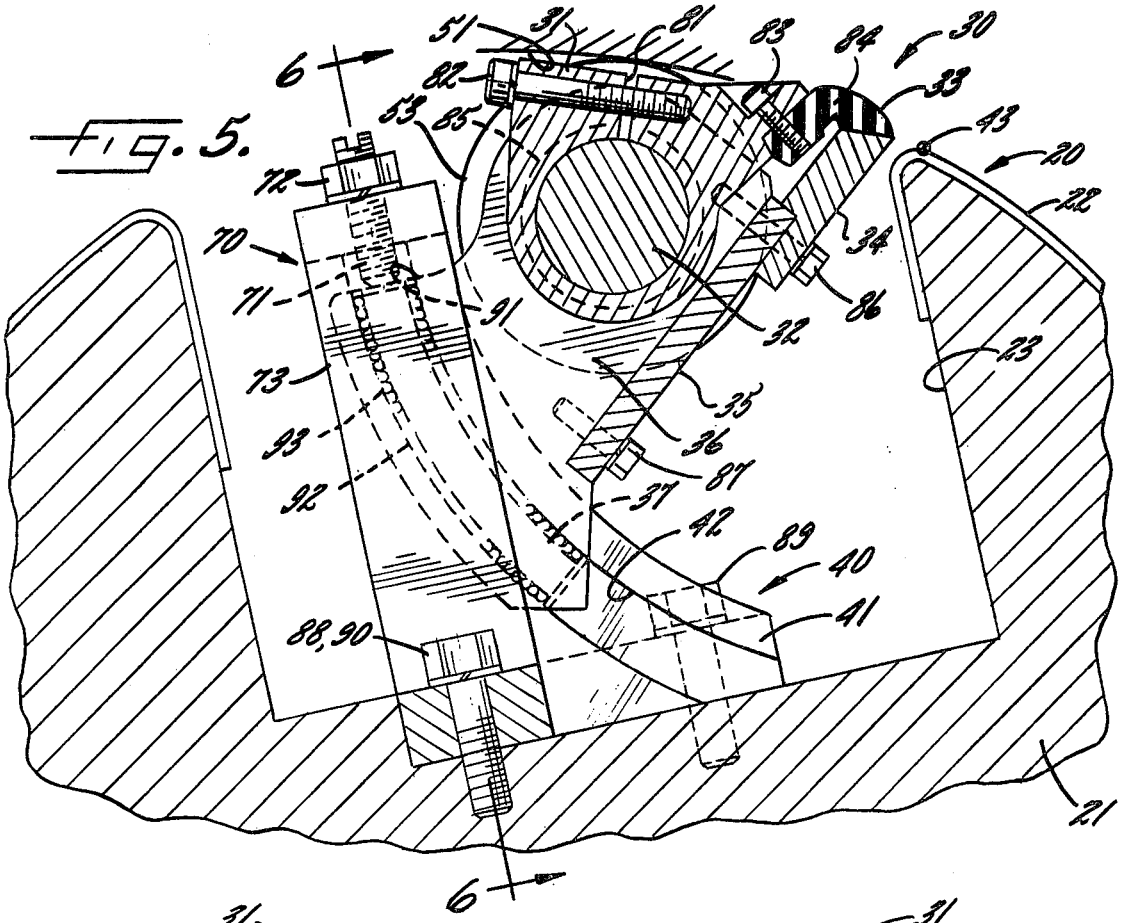
FIG. 5 is an enlarged fragmentary section taken along line 5—5 in FIG. 4 showing the mounting and stop mechanisms.

The swiveling mechanism originally shown in FIG. 1A is shown in greater detail in FIG. 5. The gripper 31 has a slot 81 so that a clamp screw 82 may be used to securely attach the gripper 31 to the gripper shaft 32 so that the gripper 31 has a proper initial angular orientation and rotates with the shaft. The gripper tooth 33 is fastened to the gripper 31 by a retaining screw 83. The gripper tooth 33 is preferably made of a resilient material and has a relatively narrow bridge portion 84 so that the gripping force on the leading edge 11 of the sheet stock 10 is generally uniformly distributed along the plurality of grippers 31 disposed along the length of the axial groove 23. The gripper shaft 32 is journaled to the gripper bracket 36 by a bearing 85. The gripper pad 34 is secured to the gripper bar 35 and gripper bracket 36 by a retaining screw 86. Similarly the gripper bar 35 is also secured to the gripper bracket by the retaining screw 87. The guide support 41 is secured to the body 21 of the impression cylinder 20 by two bolts 88 and 89.

FIG. 5 also shows a swiveling stop mechanism generally designated 70 that was omitted from FIG. 1A for clarity. The stop mechanism is comprised of a stop adjusting screw 71, a stop jam nut 72 and a stop supporting element 73. The outward extent of the gripper bracket 36 is set by the position of the end of the stop adjusting screw 71. A bolt 90 secures the stop supporting element to the body 21 of the impression cylinder 20. As shown in FIG. 4, a plurality of pairs of adjustable stops and stop holders are used at spaced positions along the length of the cylinder groove so that the maximum extended swiveling position is precisely defined at a number of points along the length of the cylinder. Thus, the sheet entryway between the gripper teeth 33 and pads 34 is preferably set to a constant width along the length of the cylinder by individual adjustment of the stop adjusting screws 71.

Figure 6:
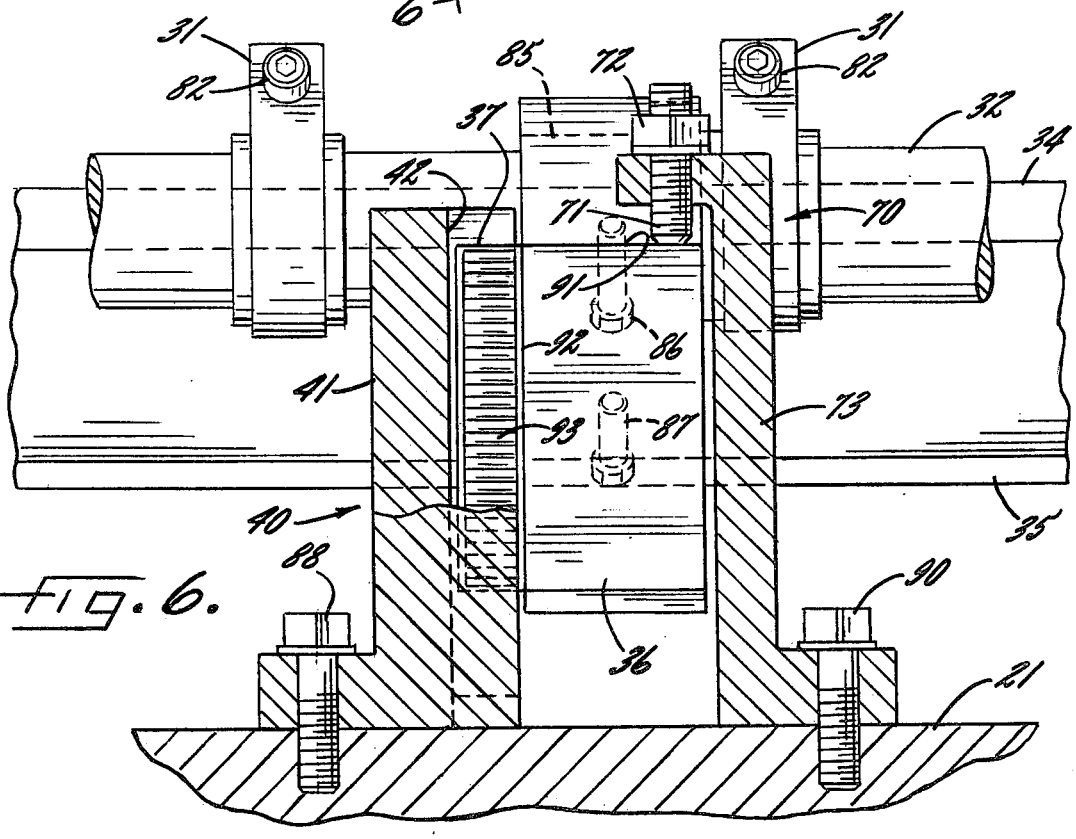
FIG. 6 is an enlarged elevational view in partial section taken along the section line 6—6 in FIG. 5 corresponding to the view of FIG. 4.

The operation of the stop is more clearly shown in FIG. 6. The stop adjusting screw 71 does not rest on the arcuate lug 37, but rather rests on a stop surface 91 of the gripper bracket 36. Simultaneous reference to FIG. 5 and FIG. 6 also shows that flat needle cages 92 enclose needle bearings 93 that fit in between the cooperating surfaces of the arcuate groove 52 and lug 37 and that the groove and lug are of only a fraction of the axial width of the gripper bracket 36 and guide supporting element 41 so that the swiveling of the gripper mechanism 30 is rigidly guided by the guiding mechanism 40.

As further shown in FIG. 4, a plurality of swiveling mechanisms 40 are used at spaced positions along the length of the cylinder groove so that the swiveling of a large number of grippers 31 is precisely defined along the entire length of the cylinder. Consequently, play in the mechanism is reduced and resonant vibrations are eliminated. Thus, the mounting of the gripper shaft has sufficient stability for high quality, high speed printing.

I claim as my invention:

1. In an impression cylinder construction for use in a sheet-fed rotogravure press or the like in which the plate cylinder has a substantially continuous outer surface free of any substantial gap comprising, in combination, a frame, an impression cylinder having an axial groove in the surface thereof, the groove having a trailing edge, gripper supporting brackets spaced along the groove, gripper pads on the respective brackets positioned adjacent and inwardly of the trailing edge of the groove, a gripper shaft extending axially in the groove and journaled in the gripper brackets, the gripper shaft having secured thereto a spaced set of grippers rockable with the gripper shaft between open and closed positions with respect to the pads for gripping the leading edge of a sheet, mounting means in the groove and secured to the cylinder for mounting the brackets for swinging movement between (1) an extended position in which the grippers extend outwardly of the cylinder surface to define a sheet entry way which is substantially flush with the cylinder surface and oriented to receive sheets fed in the same direction as the axial groove moves as the impression cylinder is rotated, and (2) a retracted position in which the brackets are swung inwardly with respect to the groove, and means including a spring pressed cam follower at the end of the shaft and a cooperating cam surface fixed to the frame for sequentially (a) closing the grippers on the leading edge of a sheet with the grippers in extended position and (b) moving the brackets to their retracted position thereby to retract the grippers totally below the surface of the impression cylinder to preclude interference between the grippers and the substantially continuous surface of the plate cylinder as the cylinders revolve, the swinging movement of the brackets being centered on a longitudinal swing axis lying at the trailing edge of the groove on the cylinder surface thereby eliminating binding of the fed sheets against the trailing edge of the groove.

2. The combination as claimed in claim 1, wherein the mounting means includes a plurality of cooperating arcuate way surfaces respectively secured to the gripper brackets and to the cylinder spaced along the length of the groove for guiding the brackets for swinging movement about the swing axis, so that the gripper brackets in the middle of the cylinder as well as the gripper brackets at the ends of the cylinder have accurate and stable swiveling.

3. In an impression cylinder construction for use in a sheet-fed rotogravure press or the like in which the plate cylinder has a substantially continuous outer surface free of any substantial gap comprising, in combination, a frame, an impression cylinder having an axial groove on the surface thereof, the groove having a trailing edge, gripper supporting brackets spaced along the groove, gripper pads on the respective brackets positioned adjacent and inwardly of the trailing edge of the groove, a gripper shaft extending axially in the groove and journaled in the gripper brackets, the gripper shaft having secured thereto a spaced set of grippers rockable with the gripper shaft between open and closed positions with respect to the pads for gripping the leading edge of a sheet, mounting means in the groove and secured to the cylinder for mounting the brackets for swinging movement between (1) an extended position in which the grippers extend outwardly of the cylinder surface to define a sheet entry way which is substantially flush with the cylinder surface and oriented to receive sheets fed in the same direction as the axial groove moves as the impression cylinder is rotated, and (2) a retracted position in which the brackets are swung inwardly with respect to the groove, the mounting means including cooperating arcuate way surfaces on the brackets and secured to the cylinder for guiding the brackets for swinging movement about a longitudinal axis lying at the trailing edge of the groove on the cylinder surface thereby eliminating binding of the fed sheets against the trailing edge of the groove, and means for sequentially (a) closing the grippers on the leading edge of the sheet with the grippers in extended position and (b) moving the brackets to their retracted position accompanied by inward translation of the gripper shaft thereby to retract the grippers totally below the surface of the impression cylinder to preclude interference between the grippers and the substantially continuous surface of the plate cylinder as the cylinders revolve.

4. The combination as claimed in claim 3, wherein the means for moving the brackets to their retracted position includes a cam follower connected to the end of the shaft and a cooperative cam surface fixed to the frame so that retraction of the brackets is synchronized to the rotation of the cylinder.

5. In an impression cylinder construction for use in a sheet-fed rotogravure press or the like in which the plate cylinder has a substantially continuous outer surface free of any substantial gap comprising, in combination, a frame, an impression cylinder having an axial groove in the surface thereof, the groove having a trailing edge, gripper supporting brackets spaced along the groove, gripper pads on the respective brackets positioned adjacent and inwardly of the trailing edge of the groove, a gripper shaft extending axially in the groove and journaled in the gripper brackets, the gripper shaft having secured thereto a spaced set of grippers rockable with the gripper shaft between open and closed positions with respect to the pads for gripping the leading edge of the sheet, mounting means in the groove and secured to the cylinder for mounting the brackets for swinging movement between (1) an extended position in which the grippers extend outwardly of the cylinder surface to define a sheet entry way which is substantially flush with the cylinder surface and oriented to receive sheets fed in the same direction as the axial groove moves as the impression cylinder is rotated, and (2) a retracted position in which the brackets are swung inwardly with respect to the groove, the swinging movement being centered about an axis which lies at and parallel to the trailing edge of the groove on the cylinder surface thereby eliminating binding of the fed sheets against the trailing edge of the groove, means including a biasing spring, a cam follower at the end of the shaft and a cooperating cam surface fixed to the frame for sequentially (a) closing the grippers on the leading edge of the sheet with the grippers in extended position, (b) moving the brackets to their retracted position thereby to retract the grippers below the surface of the impression cylinder to preclude interference between the grippers and the substantially continuous surface of the plate cylinder as the cylinders revolve, (c) restoring the brackets and the grippers thereon to their extended position and (d) opening the grippers to release the leading edge of the sheet thereby to complete a periodic cycle for processing individual sheets.

6. The combination as claimed in claim 3 or claim 5, wherein the mounting means further includes bearings with cages enclosing flat needle bearings disposed between a plurality of arcuate way surfaces secured to the gripper brackets and their cooperating arcuate way surfaces secured to the cylinder.

7. The combination as claimed in claim 5, wherein the means for sequentially moving the gripper brackets to their retracted position includes a cam follower connected to each end of the shaft and cam surfaces fixed to the frame cooperating with each of the cam followers and having approximately identical cam profiles with respect to the cylinder axis so that the swiveling of the brackets is driven uniformly at each end of the shaft.

8. The combination as claimed in claim 7 wherein the cam followers are coaxial with and journaled to the shaft so that forces on the cam followers are directly transmitted to the shaft.

9. The combination as claimed in claim 8, wherein the cam surfaces are internal surfaces facing the axis of cylinder rotation, and wherein the means for sequentially moving the gripper brackets to their retracted position includes a compression-type bias spring for each cam follower, connected to the cylinder and the cam followers so as to force the cam follower outward from the cylinder axis onto the cam surfaces, so that the cam follower precisely tracks the cam surface.

10. The combination as claimed in claim 9 wherein the means for sequentially closing the grippers on the leading edge of the sheet includes a pivot arm, secured to one end of the shaft, a cam follower journaled to the pivot arm on an axis generally parallel but offset from the axis of the shaft, and a cam surface fixed to the frame cooperating with the cam follower journaled to the pivot arm, so that relative differences in radial distances from the axis of the cylinder to the tangent points of the cam followers coaxial with the shaft and the cam follower journaled to the pivot arm cause a corresponding rotation of the gripper shaft and rocking of the grippers with respect to the cylinder and synchronized to cylinder rotation.

11. The combination as claimed in claim 3 or claim 5, wherein the mounting means includes at least one adjustable stop secured to at least one gripper bracket and at least one cooperating stop holder secured to the cylinder within the groove, the adjustable stop adjusting the maximum extent of the extended swinging motion of the gripper brackets, so that the positions of the gripper pads are precisely defined for reliably receiving the sheets fed along the sheet entry way.

12. The combination as claimed in claim 11 wherein a plurality of pairs of adjustable stops and adjustable stop holders are disposed along the length of the cylinder groove, so that the positions of the gripper pads are precisely defined along the entire length of the cylinder.

* * * * *